United States Patent [19]

Hidler et al.

[11] 4,253,085

[45] Feb. 24, 1981

[54] FLASHING LIGHT INDICATOR STRUCTURES

[75] Inventors: Henry T. Hidler, Danvers; John M. Lo, Newton; John A. Pappas, Winthrop, all of Mass.

[73] Assignee: GTE Products Corporation, Stamford, Conn.

[21] Appl. No.: 937,649

[22] Filed: Aug. 28, 1978

[51] Int. Cl.[3] ..... E01F 9/00

[52] U.S. Cl. ..... 340/114 B; 340/84; 340/90; 340/105; 40/558; 40/612; 116/63 R; 315/241 R; 362/263

[58] Field of Search ..... 340/114 R, 114 B, 81 R, 340/82, 83, 90, 84, 87, 105, 321, 331, 332; 116/63 R, 63 P, 63 C, 63 T, DIG. 26; 40/431, 541, 546, 547, 557, 558; 315/199, 200 A, 241 R, 241 S; 404/6; 362/84, 152, 217, 218, 219, 222, 223, 224, 294, 297, 302, 263, 305, 300, 310

[56] References Cited

U.S. PATENT DOCUMENTS

| | | | |
|---|---|---|---|
| 2,308,844 | 1/1943 | Wilshusen | 340/87 |
| 2,344,639 | 3/1944 | Ressinger | 40/541 |
| 3,078,452 | 2/1963 | Olson | 340/81 |
| 3,153,773 | 10/1964 | Wood | 340/114 |
| 3,233,352 | 2/1966 | Projector et al. | 40/541 |
| 3,380,428 | 4/1968 | Abrams | 116/63 P |
| 3,456,100 | 7/1969 | Green | 116/63 P |
| 3,544,782 | 12/1970 | Hahn | 362/152 |

*Primary Examiner*—John W. Caldwell, Sr.
*Assistant Examiner*—Donnie L. Crosland
*Attorney, Agent, or Firm*—Edward J. Coleman

[57] ABSTRACT

An indicator structure including one or more lengths of perforated tubing arranged in a desired configuration, such as a traffic barricade. The tubing contains one or more flash lamps which produce a light-tunnel effect during operation to provide a high intensity warning or indicating signal in a pre-selected configuration of flash illumination via the tubing perforations.

18 Claims, 6 Drawing Figures

FLASHING LIGHT INDICATOR STRUCTURES

BACKGROUND OF THE INVENTION

This invention relates generally to indicator structures and, more particularly, to flashing light indicator structures for warning, signaling, or directional display purposes.

Indicator structures of several types are well known as devices to warn people of dangeous areas. For example, at railroad crossings, the conventional indicator standard comprises a set of panels arranged in an X-shaped configuration with blinking incandescent warning lights mounted thereon. Areas of roads and highways that are under construction are marked off by traffic barricades, each in the form of a horizontal warning panel supported at each end by a set of legs. Generally, a blinking amber light is mounted on the top panel of the barricade, such as illustrated in U.S. Pat. No. 3,802,667. Direction display devices, such as those employed in diverting traffic on closed highway lanes, have comprised an array of sequentially blinking incandescent lamps arranged in a configuration, such as an arrow, to indicate direction.

Although useful in their applications, prior art indicator structures, such as those described above, exhibit a number of shortcomings with respect to cost, signal-light intensity, and/or area of illumination provided per lamp.

SUMMARY OF THE INVENTION

Accordingly, it is an object of the present invention to provide an improved indicator structure.

It is a particular object to provide a flashing light indicator structure having increased intensity and area of illumination per lamp.

A further object is to provide an improved flashing light indicator structure which effectively displays direction without the need for a large plurality of individual lamps.

These and other objects, advantages, and features are attained, in accordance with the principles of the present invention, by an indicator structure comprising a length of perforated tubing having an arc discharge flashlamp disposed in alignment therewith for radiating light through the interior of the tubing during operation. Preferably, the flashlamp is dispsed within the tubing at one end, and the perforations are equal-sized circular holes uniformly distributed throughout the length of the tubing. In this manner, when the arc discharge lamp flashes, the tubing functions as a light tunnel and an intense flash illumination effect is provided via the perforations throughout the overall length of the tubing. The efficiency of the illumination output can be enhanced by increasing the reflectivity of the interior surface of the tubing with a coating, such as white paint. By providing a second arc discharge lamp at the other end of the length of perforated tubing and flashing the lamps in alternate sequence, a very effective illusion of direction is readily provided in an efficient manner through the perforations over the full length of the tubing, without the need for a structure supporting a large number of small incandescent lamps which must be blinked in sequence. The sections of perforated tubing can be arranged in various configurations, including traffic barricades, directional arrows, and X-shaped railroad crossing warning symbols.

BRIEF DESCRIPTION OF THE DRAWINGS

This invention will be more fully described hereinafter in conjunction with the accompanying drawings, in which.

DESCRIPTION OF PREFERRED EMBODIMENT

Figure 1:
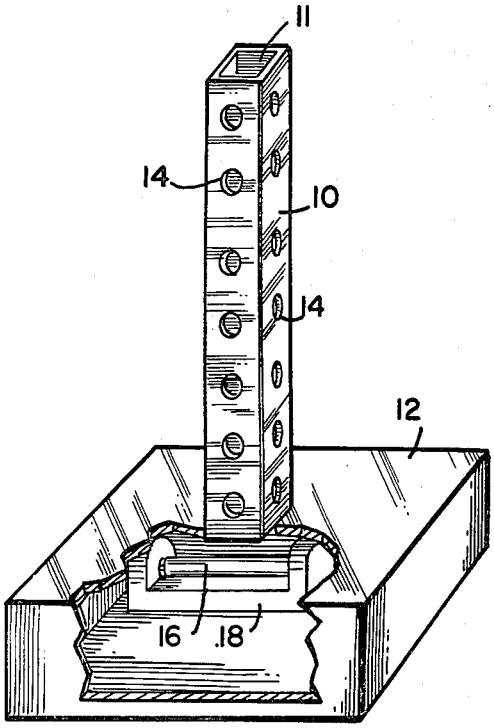
FIG. 1 is a simplified perspective view of one embodiment of the invention wherein the indicator structure is in the configuration of a vertical standard, the base portion being broken away to show the location of the flashlamp.

In the embodiment of FIG. 1, the flashing light indicator structure of the invention is illustrated in the configuration of a vertical standard, such as might be used as a signal warning or location marking device. A length of perforated tubing 10 is attached at one end, such as by bolts or welding, to a base 12. The tubing shown on the drawings is illustrated as having a rectangular cross section and the perforations are depicted as equal-sized circular holes 14 uniformly distributed throughout the length of the tubing. The perforations, or holes, 14 are located on all four sides of the tubing. Such perforated tubing is commercially available, for example, from the Unistrut Corporation, Wayne, Michigan, as "TELESPAR" tubing. This commercial tubing is square-shaped, made from 12-gauge galvanized steel, and welded at the corner. Various cross sections are available from $1\frac{1}{2}'' \times 1\frac{1}{2}''$ to $2\frac{1}{2}'' \times 2\frac{1}{2}''$. A $2'' \times 3''$ cross section is also available. The tubing is also made from 10-gauge steel, which may be plain or galvanized. The perforations 14 are 7/16" diameter holes spaced 1" on center on all four sides.

Although a specific tubing has been referred to, it is to be understood that a variety of types of perforated tubing are contemplated as suitable for different applications. For example, the tubing may be circular, of a different material than steel, have nonuniformly distributed perforations, have perforations on only one or two sides with the remaining sides of the tubing being solid, and the perforations may be in the form of opening configurations other than circular.

In accordance with the present invention, this conventional tubing 10 is converted into a unique and very effective indicator structure by disposing an arc discharge flashlamp 16 in alignment with the length of tubing 10 for radiating light through the interior of the tubing during operation. In FIG. 1, the tubular-shaped flashlamp 16 is shown mounted within base 12 in alignment with the open bottom end of the length of tubing 10 which is vertically oriented on the base. The top of this length of tubing may be opened or closed. The lamp 16 is mounted on an operating fixture 18, which may contain a conventional battery-powered flashlamp operating circuit or a circuit which is powered through a cord connected to an AC source.

Flashlamps of the type referred to herein generally comprise two spaced-apart electrodes within an hermetically-sealed glass envelope having a rare gas fill, typically xenon, at a sub-atmospheric pressure. A variety of envelope configurations are employed for different applications, with the most common types being straight tubular or a helically configured tube. In typical prior art operating circuits, such lamps are connected across an energy storage device, such as one or more capacitors, charged to a substantial potential, but insufficient to ionize xenon gas fill. Upon application of an additional pulse of sufficient voltage, the xenon is ionized and an electric arc is formed between the two electrodes, discharging the storage device through the flashlamp, which emits a burst of intense light. A particularly useful AC circuit for operating an arc discharge flashlamp without the need for large banks of storage capacitors is described in U.S. Pat. No. 4,095,140, assigned to the present assignee.

In the present application, the length of perforated tubing 10 serves as a light tunnel for the burst of intense light from flashlamp 16, whereupon light is reflected by the interior surface 11 of the tubing and escapes, or is visible, through the many perforations 14. The resulting effect, as viewed by one observing the indicator structure either in daylight or at night, is a bright, intense pattern of illumination from the many perforations 14 distributed throughout the length of tubing 10. If a sequencing means, such as an astable multivibrator, is included in the triggering circuit for the lamp, the flash burst of light will be repeated in sequence at predetermined intervals. The end result is a bright indicator flash pattern over an extended display area. In particular, larger areas of more intense light are achieved in a more economical manner by means of the indicator structure of the invention than can be obtained with conventional incandescent light source and lens systems.

According to a further aspect of the invention, the efficiency of illumination output from the indicator structure is significantly enhanced by applying a coating to the interior surfaces 11 of the perforated tubing 10 for increasing the reflectivity thereof. For example, white paint can be applied to the interior surface 11. In one specific embodiment of the invention, all tubing surfaces, both interior and exterior, were coated with a white reflector enamel of the type used to coat the reflecting surfaces of fluorescent lamp fixtures. This provided the multiple functions of enhanced interior surface reflectivity, corrosion protection for all surfaces, and enhanced visibility of the structure at night with the flashlamp not operating. An additional increase in the reflectivity of the interior surfaces can be achieved by using phosphorescent coatings or paint coatings containing glass particules or glass microbeads.

Figure 2:
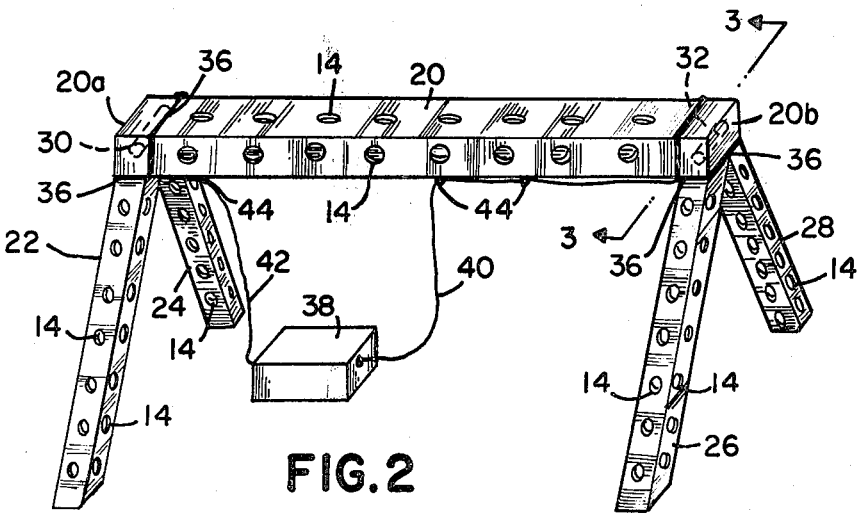
FIG. 2 is a simplified perspective view of another embodiment of the invention wherein the indicator structure is in the configuration of a traffic barricade.

FIG. 2 illustrates a length of perforated tubing 20 supported horizontally by four perforated tubing members 22, 24, 26, and 28 arranged as legs and attached, such as by bolts or welding, to the ends of the horizontal tubing member 20 forming a "saw horse" type traffic barricade. The end portions 20*a* and 20*b* of the horizontal length of tubing 20 may be integral parts of tubing 20 or separately attached nonperforated members. In either event, one or both of these end sections support an arc discharge flashlamp in alignment with all of the perforated tubing members joined thereto. In FIG. 2 as illustrated by dashed lines, a flashlamp 30 is mounted within end section 20*a*, and a flashlamp 32 is mounted within end section 20*b*.

Figure 3:
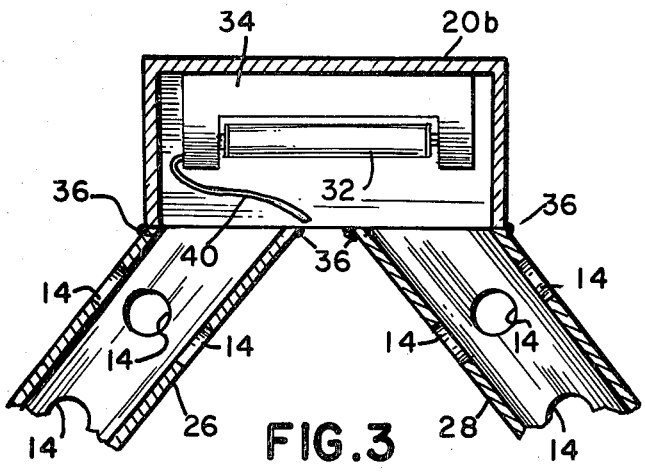
FIG. 3 is a fragmentary cross-sectional view taken along line 3—3 of FIG. 2.

A typical mounting arrangement of a flashlamp in the traffic barricade of FIG. 2 is best illustrated in the sectional view of FIG. 3. In this instance, the straight tubular flashlamp 32 is electrically secured in an operating fixture 34 mounted (by means not shown) within end section 20. The perforated tubing members are welded to the end section at points 36. Lamp 32 is disposed so that upon flashing, the burst of light will travel through the interior portions of the perforated tubing members 20, 26, and 28. In like manner, lamp 30 is oriented such that its burst of light travels through tubing members 20, 22, and 24 (FIG. 2). The fixture 34 supporting lamp 32 is connected to an operating circuit and power source 38 by means of a cord or cable 40. In like manner, the fixture supporting lamp 30 is connected to the operating circuit and power source by means of a cable or cord 42. The operating circuit and power source may be housed in a weather-sealed package adapted for resting on the ground, and the cables may be dressed by means such as clamps 44 attached to and depending from member 20.

With lamps mounted at each end of the barricade, as illustrated in FIG. 2, the illusion of direction can be provided by flashing lamps 30 and 32 in alternate sequence. Of particular advantage, this sequential and very effective directional flashing is provided by lamps that are mounted internal to the traffic barricade structure with no lenses exposed for breakage.

Figure 4:
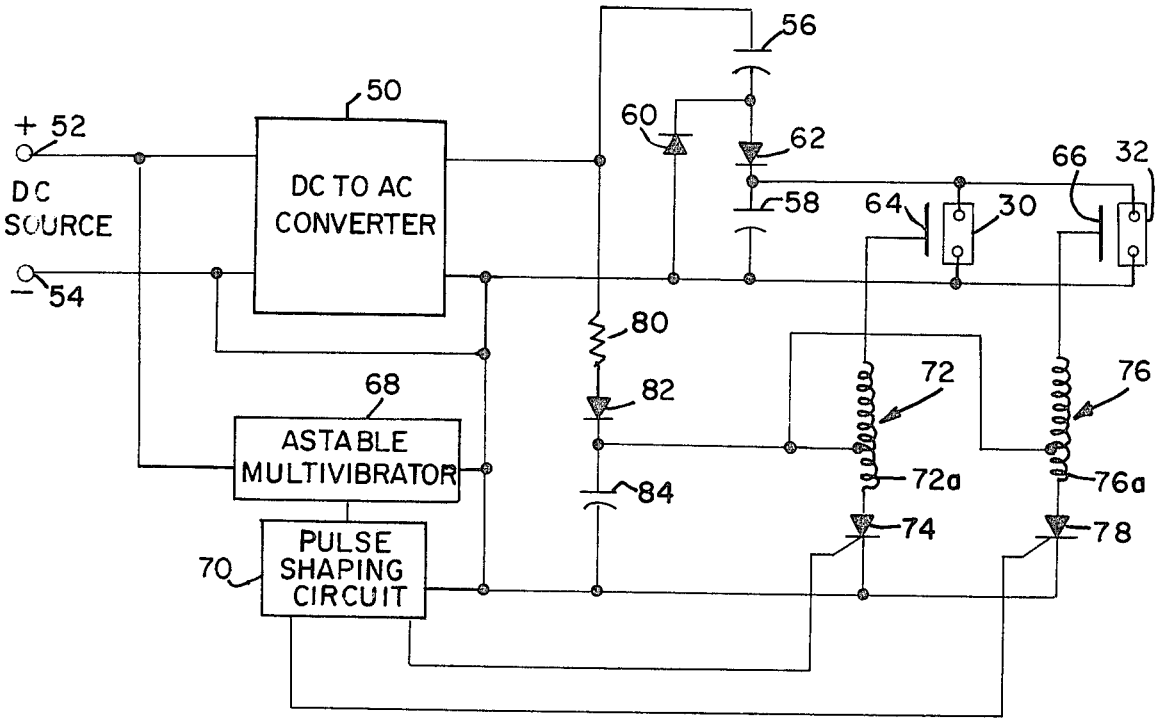
FIG. 4 is a schematic diagram of a flashlamp operating circuit useful in the indicator structure of FIG. 2.

A particularly useful, battery-powered operating circuit for providing such alternate sequential flashing is illustrated in FIG. 4 and described in copending application, Ser. No. 937,648, now U.S. Pat. No. 4,185,232, filed concurrently herewith and assigned to the present assignee. Briefly, the circuit includes a DC to AC converter 50 having a pair of inputs connected to the positive and negative terminals 52 and 54, respectively, of a DC source, such as a battery. For example, in a preferred embodiment, the source ranged from 9 to 15 volts DC, and a 60-watt converter 50 was employed for converting a 12.6 volt DC input to a 115 volts, 400 Hz. output. The negative reference line output of the converter is connected back to the negative terminal 54 and it is also connected to one terminal of a voltage doubler circuit comprising capacitors 56 and 58 and diodes 60 and 62 connected as illustrated. The output of the voltage doubler, developed across capacitor 58, is connected in parallel to the electrodes of the flashlamps 30 and 32. In this manner, the single capacitor 58 functions as the storage discharge device for both of the flashlamps 30 and 32.

In FIG. 4, the lamps 30 and 32 are illustrated as being shunt triggered via external electrodes 64 and 66, respectively. The trigger pulses are developed by a circuit comprising an astable multivibrator 68 connected across the DC terminals 52 and 54 and providing a timing waveform output to a pulse-shaping circuit 70. For example, circuit 70 may comprise an active differentiator network for providing sharp, spike-like gating pulses on two separate output lines, each of the two outputs having the same pulse repetition rate but being time interlaced. For example, in a preferred embodiment, each of the output lines from the pulse-shaping circuit provided a 10-volt, 2-microsecond pulse at two-second intervals; however, the time phase of one output line was offset by one second with respect to the other output line.

The trigger circuitry further includes an autotransformer 72 and silicon-controlled rectifier (SCR) 74 serially connected in that order between the external electrode 64 (for lamp 30) and the reference line connected to the negative terminal 54 of the DC source. A second autotransformer 76 and SCR 78 are serially connected in that order between the external electrode 66 of lamp 32 and the reference line connected to negative terminal 54. Connected between the positive output terminal of converter 50 and the negative reference line are a charging resistor 80, a diode 82 and a capacitor 84. The junction of diode 82 and capacitor 84 is connected to a tap on both autotransformers 72 and 76. Hence, capacitor 84 is connected across the primary 72*a* of autotransformer 72 and SCR 74 and across the primary 76*a* of autotransformer 76 and SCR 78. The gate electrodes of both SCR 74 and 78 are respectively connected to the two output lines of the pulse-shaping circuit 70.

Assuming the aforementioned gating pulse output at two-second intervals with the two outputs respectively offset by one second, the characteristics of converter 50 and the value of capacitor 56 are selected to control the charge rate of capacitor 58 so that it will become fully charged within one second, after having been discharged. In the trigger circuit, resistor 80 and capacitor 84 are selected to provide an RC constant which assures that capacitor 84 will become fully charged within one second, after having been discharged. Upon energizing the circuit, therefore, the supply circuit capacitor 58 and the trigger circuit capacitor 84 will become fully charged. The generation of the two sets of alternately occuring output pulses from the pulse-shaped circuit 70 will cause SCR's 74 and 78 to alternately discharge capacitor 84 through the primaries 72*a* and 76*a*, respectively, of the autotransformers, 72 and 76. The resulting high voltage trigger pulses appearing across the secondaries of transformers 72 and 76 are alternately applied to the external electrodes 64 and 66 to cause alternate triggering of the flashlamps 30 and 32, which are both connected across the single storage capacitor 58. Hence, alternate flashing of the lamps 30 and 32 is provided by a DC circuit which includes only one supply storage capacitor 58, which recharges between each lamp flash, and a single trigger capacitor 84, which recharges between each SCR activation by a gating pulse.

Figure 5:
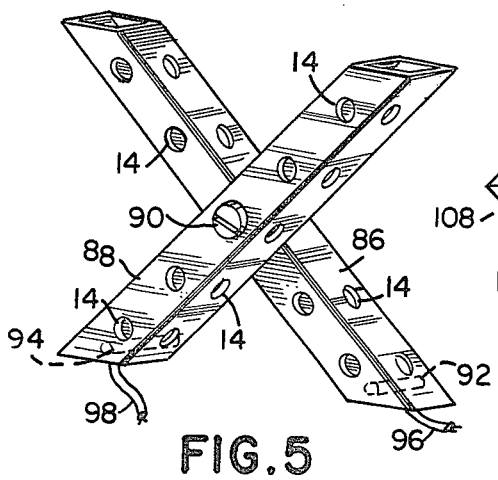
FIG. 5 is a simplified perspective view of yet another embodiment of the invention wherein the indicator structure has an X-shaped configuration, such as may be used as a warning signal at a railroad crossing.

FIG. 5 illustrates another embodiment of an indicator structure according to the invention in which two lengths of perforated tubing 86 and 88 are attached to each other, such as by a bolt 90, in an X-shaped configuration. As illustrated by dashed lines, a flashlamp 92 is disposed at one end of the tubing member 86, and a flashlamp 94 is disposed at one end of the tubing section 88. The lamps are disposed so that on flashing, either together or in alternate sequence, bursts of light travel through the respective interior portions of the perforated tubing members 86 and 88. Lamps 92 and 94 are energized by power cords 96 and 98, respectively. The resulting flashes of light which travel through the crossed tubing members and are visible via perforations 14 provide a very effective signal indicator suitable, for example, as a railroad crossing warning device.

Figure 6:
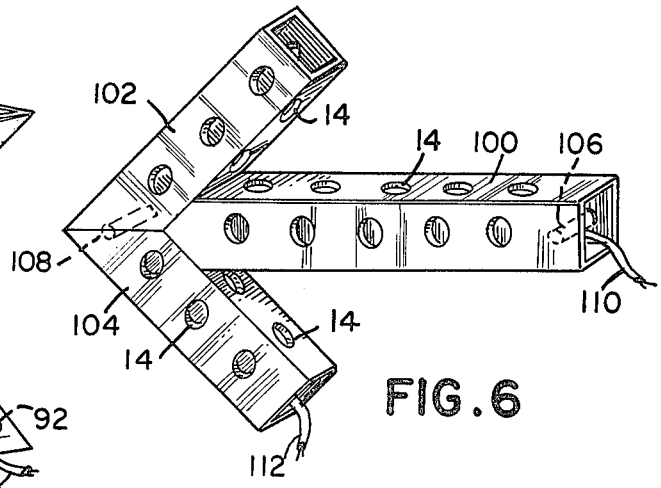
FIG. 6 is a simplified perspective view of a further embodiment of the invention wherein the indicator structure is in the configuration of an arrow.

In the embodiment shown in FIG. 6, the perforated tubing is arranged in the configuration of an arrow. For example, as illustrated, the arrow-shape may be formed by a perforated tubing member 100 having a V-cut at one end at which a pair of shorter tubing members 102 and 104, having diagonal cuts at their respective ends, are mounted, such as by welding, in the form of an arrow point. As illustrated by dashed lines, a flashlamp 106 is mounted at the shank end of perforated tubing member 100, and a flashlamp 108 is mounted at the arrow point end of the structure. The lamps 106 and 108 are energized by power cords 110 and 112 respectively. Connecting a circuit, such as that illustrated in FIG. 4, to energize the lamps 106 and 108 via their respective power cords will provide flashing of the lamps in alternate sequence to very effectively provide a directional display indicator. The flash of light from lamp 106 travels through the interior portions of tubing member 100 and is visible via the perforations 14 therein, while the alternately occuring burst of light from lamp 108 will travel through the interior portions of tubing sections 100, 102, and 104 and be visible through the perforations 14 therein.

A particularly useful AC circuit for operating two arc discharge flashlamps in sequence by use of a charge-discharge capacitor but without the need for a large bank of storage capacitors is described in copending Application Ser. No. 865,564 filed Dec. 29, 1977 now U.S. Pat. No. 4,142,130 and assigned to the present assignee.

Of course, each of the aforementioned indicator structures can employ the aforementioned reflection-enhancing coating, such as white paint, on the interior surfaces of the perforated tubing in order to provide an enhanced illumination output.

Although the invention has been described with respect to specific embodiments, it will be appreciated that modifications and changes may be made by those skilled in the art without departing from the true spirit and scope of the invention.

What we claim is:

1. An indicator structure for signaling or warning applications comprising a length of perforated metal tubing, an arc discharge flashlamp with a xenon gas fill disposed in alignment with said length of tubing for radiating an intense burst of light through the interior of said tubing during operation, and means for operating said flashlamp.

2. The structure of claim 1 wherein said flashlamp is disposed within said tubing.

3. The structure of claim 2 wherein said flashlamp is disposed at one end of said length of tubing.

4. The structure of claim 1 wherein said tubing has perforations uniformly distributed throughout the length thereof.

5. The structure of claim 4 wherein said tubing has a rectangular cross-section.

6. The structure of claim 5 wherein said perforations are located on all sides of said tubing.

7. The structure of claim 4 wherein said perforations are equal-sized circular holes in said tubing.

8. The structure of claim 3 further including a second arc discharge flash lamp disposed in said length of tubing at the opposite end from that at which said first-mentioned flash lamp is disposed, and means for operating said second flash lamp.

9. The structure of claim 8 wherein said means for operating said first and second lamps provides flashing thereof in alternate sequence.

10. The structure of claim 1 further including a plurality of perforated tubing members configured as legs and attached to each end of said first-mentioned length of perforated tubing for forming a traffic barricade, said flash lamp being disposed at one end of said first-mentioned length of tubing in alignment with the leg members of tubing attached thereat for radiating light therethrough during operation.

11. The structure of claim 10 further includes a second arc discharge flash lamp disposed in said first-mentioned length of tubing at the opposite end from that at which said first-mentioned flash lamp is disposed, said second flash lamp being in alignment with the leg members of tubing attached to the end at which said second lamp is disposed for radiating light through said last-mentioned leg members during operation, and means for operating said second flash lamp to provide flashing thereof in alternate sequence with respect to said first-mentioned lamp.

12. The structure of claim 1 further including a second length of perforated tubing attached to said first-mentioned length of tubing in an X-shaped configuration.

13. The structure of claim 12 wherein said flash lamp is disposed at one end of said first-mentioned length of tubing, and further including a second arc discharge flash lamp disposed at one end of said second length of tubing, and means for operating said second flash lamp to provide alternate flashing thereof in alternate sequence with respect to said first-mentioned lamp.

14. The structure of claim 1 wherein said length of perforated tubing has the configuration of an arrow, and said flash lamp is disposed at one end of said length of tubing.

15. The structure of claim 14 further including a second arc discharge flash lamp disposed in said length of tubing at the opposite end from that at which said first-mentioned flash lamp is disposed, and means for operating said second flash lamp to provide flashing thereof in alternate sequence with respect to said first-mentioned lamp.

16. The structure of claim 1 further including a coating on the interior surface of said length of perforated tubing for increasing the reflectivity of said interior surface.

17. The structure of claim 16 wherein said coating comprises a white paint.

18. The structure of claim 16 wherein said coating contains glass particles or microbeads.

* * * * *